US005896113A

United States Patent [19]

O'Neill, Jr.

[11] Patent Number: 5,896,113

[45] Date of Patent: Apr. 20, 1999

[54] QUADRIFILAR HELIX ANTENNA SYSTEMS AND METHODS FOR BROADBAND OPERATION IN SEPARATE TRANSMIT AND RECEIVE FREQUENCY BANDS

[75] Inventor: Gregory A. O'Neill, Jr., Apex, N.C.

[73] Assignee: Ericsson Inc., Research Triangle Park, N.C.

[21] Appl. No.: 08/771,635

[22] Filed: Dec. 20, 1996

[51] Int. Cl.[6] ..... H01Q 1/36

[52] U.S. Cl. ..... 343/895; 343/853; 455/277.1

[58] Field of Search ..... 343/702, 895, 343/850, 853, 893, 860, 876; 455/78, 88, 123, 277.1

[56] References Cited

U.S. PATENT DOCUMENTS

| | | | |
|---|---|---|---|
| 3,083,364 | 3/1963 | Scheldorf | 343/843 |
| 4,008,479 | 2/1977 | Smith | 343/895 |
| 4,012,744 | 3/1977 | Greiser | 343/895 |
| 4,031,540 | 6/1977 | Borys, Jr. | 343/860 |
| 4,103,304 | 7/1978 | Burnham et al. | 343/853 |
| 4,349,824 | 9/1982 | Harris | 343/700 |
| 4,554,554 | 11/1985 | Olesen et al. | 343/895 |
| 4,608,574 | 8/1986 | Webster et al. | 343/895 |
| 4,672,686 | 6/1987 | Raoux et al. | 455/123 |
| 4,780,727 | 10/1988 | Seal et al. | 343/895 |
| 4,827,270 | 5/1989 | Udagawa et al. | 343/853 |
| 5,054,114 | 10/1991 | Erickson | 455/78 |
| 5,138,331 | 8/1992 | Josypenko | 343/853 |
| 5,170,176 | 12/1992 | Yasunaga et al. | 343/895 |

(List continued on next page.)

FOREIGN PATENT DOCUMENTS

| | | |
|---|---|---|
| 0 593 185 A1 | 1/1993 | European Pat. Off. . |
| O 320 404 B1 | 3/1993 | European Pat. Off. . |
| 0 632 603 A1 | 6/1994 | European Pat. Off. . |
| 0 729 239 A1 | 8/1996 | European Pat. Off. . |
| 0791978 | 8/1997 | European Pat. Off. . |
| 0 427 654 A1 | 7/1990 | France . |
| WO 90/13152 | 11/1990 | WIPO . |
| WO 98/05087 | 2/1998 | WIPO . |
| WO 98/05090 | 2/1998 | WIPO . |

OTHER PUBLICATIONS

R. M. Fano, *Theoretical Limitations on the Broadband Matching of Arbitrary Impedances*, Technial Report No. 41, Massachusetts Institute of Technology, (Jun. 1947), pp. 56–156.

Thomas R. Cuthbert, Jr., *Broadband Impedance Matching —Fast and Simple, RF Matching Networks*, Nov. 1994, pp. 38–50.

(List continued on next page.)

*Primary Examiner*—Don Wong
*Assistant Examiner*—Tan Ho
*Attorney, Agent, or Firm*—Myers Bigel Sibley & Sajovec

[57] ABSTRACT

Quadrifilar helix antenna systems for half-duplex communications which are capable of providing a positive gain, quasi-hemispherical antenna pattern over widely separate transmit and receive frequency bands. The antenna systems according to the present invention generally comprise a quadrifilar helix antenna, first and second circuit branches for changing the resonant frequency of the antenna to first and second resonant frequencies corresponding to the transmit and receive frequency bands, and switches or other disconnection means which are used to electrically isolate the first circuit branch from the antenna during periods when the antenna is receiving a signal and to electrically isolate the second circuit branch from the antenna during periods of transmission. In a preferred embodiment, the disconnecting means are implemented as PIN diodes or radio frequency Gallium arsenide field effect transistor switches, the elements of the quadrifilar helix antenna which form each bifilar helix are short-circuited at their distal ends, and energy is fed to and induced from the antenna via receive and transmit 90° hybrid couplers which are electrically connected to the bifilar loops of the quadrifilar helix antenna. Also provided are matching means which are coupled to the elements of the quadrifilar helix antenna for increasing the operating bandwidth of the antenna.

42 Claims, 4 Drawing Sheets

U.S. PATENT DOCUMENTS

| | | | |
|---|---|---|---|
| 5,191,352 | 3/1993 | Branson | 343/895 |
| 5,198,831 | 3/1993 | Burrell et al. | 343/895 |
| 5,255,005 | 10/1993 | Terret et al. | 343/895 |
| 5,349,365 | 9/1994 | Ow et al. | 343/895 |
| 5,444,455 | 8/1995 | Louzir et al. | 343/895 |
| 5,485,170 | 1/1996 | McCarrick | 343/895 |
| 5,489,916 | 2/1996 | Waterman, et al. | 343/895 |
| 5,572,172 | 11/1996 | Standke et al. | 333/128 |
| 5,572,227 | 11/1996 | Pal et al. | 343/895 |
| 5,581,268 | 12/1996 | Hirshfield | 343/895 |
| 5,587,719 | 12/1996 | Steffy | 343/895 |
| 5,594,461 | 1/1997 | O'Neill, Jr. | 343/895 |
| 5,706,019 | 1/1998 | Darden, IV et al. | 343/895 |
| 5,754,143 | 5/1998 | Warnagiris et al. | 343/895 |

OTHER PUBLICATIONS

William E. Sabin, *Broadband HF Antenna Matching with ARRL Radio Designer, QST*, Aug. 1995, pp. 33–36.

*Maximising Monopole Bandwidth, Electronics World & Wireless World*, Dec. 1994, pp. 1027–1028.

Robert J. Dehoney, *Program Synthesizes Antenna Matching Networks for Maximum Bandwidth, QST*, May, 1995, pp. 74–81.

Mikael Öhgren, *Resonant Kvadrifilär Helixantenn för Mobilkommunikation via Satellit, Saab Ericsson Space*, Document No. SE/REP/0220/A, Jan. 5, 1996, pp. 1–71.

C.C. Kilgus, *Resonant Quadrifilar Helix Design, The Microwave Journal*, Dec. 1970, pp. 49–54.

Arlon T. Adams, et al., *The Quadrifilar Helix Antenna, IEEE Transactions of Antennas and Propogation*, vol. AP–22, No. 2, Mar. 1974, pp. 173–178.

S.A. Schelkunoff, *A General Radiation Formula, Proceedings of the I.R.E.*, Oct. 1939, pp. 660–666.

C.C. Kilgus, *Multielement, Fractional Turn Helices, IEEE Transactions on Antennas and Propogation*, Jul. 1968, pp. 499–500.

C.C. Kilgus, *Resonant Quadrifilar Helix, IEEE Transactions on Antennas and Propogation*, May, 1969, pp. 349–351.

Kraus, *Antennas*, Sections 7–18 and 7–19, pp. 332–339, date is not provided.

QUADRIFILAR HELIX ANTENNA SYSTEMS AND METHODS FOR BROADBAND OPERATION IN SEPARATE TRANSMIT AND RECEIVE FREQUENCY BANDS

FIELD OF THE INVENTION

The present invention relates generally to antenna systems for user terminal handsets. More particularly, the present invention relates to quadrifilar helix antenna systems for use with mobile telephone user handsets.

BACKGROUND OF THE INVENTION

Cellular and satellite communication systems are well known in the art for providing communications links between mobile telephone users and stationary users or other mobile users. These communications links may carry a variety of different types of information, including voice, data, video and facsimile transmissions. In typical cellular systems, wireless transmissions from mobile users are received by local, terrestrial based, transmitter/receiver stations. These local base stations or "cells" then retransmit the mobile user signals, via either the local telephone system or the cellular system, for reception by the intended receive terminals.

Many cellular systems rely primarily or exclusively on line-of-sight communications. In these systems, each local transmitter/receiver has a limited range, and consequently, a large number of local cells may be required to provide communications coverage for a large geographic area. The cost associated with providing such a large number of cells may prohibit the use of cellular systems in sparsely populated regions and/or areas where there is limited demand for cellular service. Moreover, even in areas where cellular service is not precluded by economic considerations, "black-out" areas often arise in terrestrial based cellular systems due to local terrain and weather conditions.

As such, it has been proposed to provide a combined, half-duplex, cellular/satellite communications network that integrates a limited terrestrial based cellular network with a satellite communications network to provide communications for mobile users over a large geographical area where it may be impractical to provide cellular service. In the proposed system, terrestrial based cellular stations would be provided in high traffic areas, while an L-Band satellite communications network would provide service to remaining areas. In order to provide both cellular and satellite communications, the user terminal handsets used with this system would include both a satellite and a cellular transceiver. Such a combined system could provide full communications coverage over a wide geographic area without requiring an excessive number of terrestrial cells.

In this proposed system, which is known as the Asian Cellular Satellite System, the satellite network would be implemented as one or more geosynchronous satellites orbiting approximately 22,600 miles above the equator. These satellites could provide spot beam coverage over much of the far east, including China, Japan, Indonesia and the Philippines. In this system, signals transmitted to the satellite will fall within the 1626.5 MHz to 1660.5 MHz transmit frequency band, and the signals transmitted from the satellite will fall within the 1525 MHz to 1559 MHz receive frequency band.

While integrating satellite and cellular service together in a dual-mode system may overcome many of the disadvantages associated with exclusively terrestrial based cellular systems, providing dual-mode user terminal handsets that meet consumer expectations regarding size, weight, cost, ease of use and communications clarity is a significant challenge. Consumer expectations relating to such physical characteristics and communications performance of handheld mobile phones have been defined by the phones used with conventional cellular systems, which only include a single transceiver that communicates with a cellular node which typically is located less than 20 miles from the mobile user terminal. By way of contrast, the handheld user terminals which will be used with the Asian Cellular Satellite System must include both a cellular and a satellite transceiver. Moreover, the large free space loss associated with the satellite communications aspect of the system may significantly increase the power and antenna gain which must be provided by the antenna for the satellite transceiver on the user terminal handset, as the signals transmitted to or from the satellites undergo a high degree of attenuation in traveling the 25,000 or more miles that typically separates the user handset from the geosynchronous satellites.

Furthermore, the satellite aspects of the network also may impose additional constraints on the user terminal handsets. For instance, the satellite transceiver provided with the user terminal handset preferably should provide a quasi-hemispherical antenna radiation pattern, in order to avoid the need to track a desired satellite. Additionally, the antenna which provides this quasi-hemispherical radiation pattern should transmit and receive a circularly polarized waveform, so as both to minimize the signal loss resulting from the arbitrary orientation of the satellite antenna on the user terminal with respect to the satellite and to avoid the effects of Faraday rotation which may result when the signal passes through the ionosphere. Moreover, the satellite antenna on the handheld transceiver should also have a low front-to-back ratio and low gain at small elevation angles in order to provide a low radiation pattern noise temperature.

In addition to the above constraints, it is also preferable that the handset satellite transceiver be capable of operating over the full extent of the transmit and receive frequency bands associated with the satellite network. The operating frequency band of the Asian Cellular Satellite System, however, is as large as any communications bandwidth associated with user terminal antenna systems employed in various prior art L-Band satellite communications systems. Moreover, as discussed above, the satellite network transmits signals in one frequency band (the transmit frequency subband) and receives signals in a separate frequency band (the receive frequency subband) in order to minimize interference between the transmit and receive signals. Thus the satellite transceiver on the user handset preferably provides an acceptable radiation pattern across both the transmit and receive frequency subbands.

In light of the above constraints, there is a need for handheld satellite transceivers, and more specifically, antenna systems for such transceivers, capable of transmitting and receiving circularly polarized waveforms which provide a relatively high gain quasi-hemispherical radiation pattern over separate, relatively broadband, transmit and receive frequency subbands. Such an antenna system preferably would be capable of receiving signals from, or transmitting signals to, satellites which may be located anywhere in the hemisphere. Moreover, given the handheld nature of the user terminals and consumer expectations of an antenna which is conveniently small for ease of portability, the satellite antenna system capable of meeting the aforementioned requirements should fit within an extremely small physical volume. These user imposed size constraints may also place limitations on the physical volume required by the antenna feed structure and any matching, switching or other networks required for proper antenna operation. Thus, for instance, in the Asian Cellular Satellite System, the satellite network link budgets require the satellite antenna system on the handheld phone to be capable of providing a net gain of at least 2 dBi over all elevation angles exceeding 45°, where the net gain is defined as the actual gain or "directivity" provided by the antenna minus any matching, absorption or other losses incurred in the antenna feed structure. Additionally, the antenna must also have an axial ratio of less than 3 dB while providing good front to back ratio over the entire receive frequency subband. These performance characteristics must be provided by an antenna which, along with any associated impedance matching circuits or other components, fits within a cylinder 13 centimeters in length and 13 millimeters in diameter.

Helix antennas, and in particular, multifilar helix antennas, are relatively small antennas that are well suited for various applications requiring circularly polarized waveforms and a quasi-hemispherical beam pattern. A helix antenna is a conducting wire wound in the form of a screw thread to form a helix. Such helix antennas are typically fed by a coaxial cable transmission line which is connected at the base of the helix. A multifilar helix antenna is a helix antenna which includes more than one radiating element. Each element of such a multifilar helix antenna is generally fed with an equal amplitude signal that is separated in phase by 360°/N, where N is the number of radiating antenna elements. As the phase separation between adjacent elements varies from 360°/N, the antenna pattern provided by the multifilar helix antenna tends to degrade significantly. Accordingly, the feed structure which couples the signals between the elements of a multifilar helix antenna and the transmitter/receiver preferably introduces minimal or no phase distortions so that such degradation of the antenna pattern is minimized or prevented.

A common type of multifilar helix antenna is the quadrifilar helix. The quadrifilar helix antenna is a circularly polarized antenna which includes four orthogonal radiating elements arranged in a helical pattern (which may be fractional turn), which are excited in phase quadrature (i.e., the radiated energy induced into or from the individual radiating elements is offset by 90° between adjacent radiating elements).

Quadrifilar helix antennas can be operated in several modes, including axial mode, normal mode or a proportional combination of both modes. To achieve axial mode operation, the axial length of each antenna element is typically several times larger than the wavelength corresponding to the center frequency of the frequency band over which the antenna is to operate. Operated in this mode, a quadrifilar helix antenna can provide a relatively high gain radiation pattern. However, such a radiation pattern is highly directional (i.e., it is not quasi-hemispherical) and hence axial mode operation is typically not appropriate for satellite communications terminals that do not include means for tracking the satellite.

Operated in the normal mode, each helix of a quadrifilar helix antenna is typically balun fed at the top, and the helical arms are typically of resonant length (i.e., ¼λ, ½λ, ¾λ or λ in length, where λ is the wavelength corresponding to the center frequency of the frequency band over which the antenna is to operate). These elements are wound on a small diameter with a large pitch angle. In this mode, the antenna typically provides the quasi-hemispherical radiation pattern necessary for mobile satellite communications, but unfortunately, the antenna only provides this gain over a relatively narrow bandwidth situated about the resonant frequency. Moreover, the natural bandwidth of the antenna is proportional to the diameter of the cylinder defined by the quadrifilar helix antenna, and thus, all else being equal, the smaller the antenna the smaller the operating bandwidth. As discussed above, certain emerging cellular and satellite phone applications have relatively large transmit and receive operating bandwidths. These bandwidths may approach or even exceed the bandwidth provided by quadrifilar helix antennas operated in normal mode, and this is particularly true where other system requirements significantly restrict the maximum diameter of the antenna.

In addition to the above-mentioned bandwidth limitations associated with quadrifilar helix antennas, the bandwidth over which these antennas may effectively operate may also be limited by power transfer considerations. Specifically, in operation, it is necessary to transfer electrical signals between a transmitter/receiver and the quadrifilar helix antenna. However, such power transfer typically is not lossless due to reflections which arise as a result of imperfect impedance matching between the source and the load. If large enough, the reflected power loss, which may be expressed in terms of voltage standing wave ratio ("VSWR"), may prevent the communications system from meeting its link budgets. By way of example, for the Asian Cellular Satellite System, system link budgets require that the voltage standing wave ratio, as measured at the output of the handset transmitter/receiver, be less than 1.5.

While it often is possible to match the input impedance of the quadrifilar helix antenna to the impedance of the interconnecting transmission line(s) from the transmitter/receiver, such a match will only occur over a small frequency range as the input impedance of a quadrifilar helix antenna varies significantly with frequency. Accordingly, even if a perfect match (i.e., VSWR=1.0) is not required, an acceptable match will typically still only be achievable over some finite bandwidth. This bandwidth may be less than the operating bandwidth required by emerging cellular and satellite phone applications. As such, impedance mismatches may also serve to limit the effective bandwidth of quadrifilar helix antenna systems.

Quadrifilar antennas have previously been used in a number of mobile L-Band satellite communication applications, including INMARSAT, NAVSTAR, and GPS. However, nearly all these prior art antennas were physically much too large to satisfy the size requirements of emerging satellite phone applications. Moreover, these prior art antennas also generally do not meet the size constraints imposed by these emerging applications while also providing the gain, axial ratio, noise temperature, front-to-back ratio and broadband performance that are required by these emerging applications. Accordingly, a need exists for a new, significantly smaller, satellite phone antenna system that is capable of providing a quasi-hemispherical antenna pattern with positive gain over widely separated, relatively broadband, transmit and receive frequency subbands.

SUMMARY OF THE INVENTION

In view of the above limitations associated with existing antenna systems, it is an object of the present invention to provide physically small quadrifilar helix antenna systems for satellite and cellular phone networks.

Another object of the present invention is to provide quadrifilar helix antenna systems capable of providing a radiation pattern with a directivity exceeding 3 dBi over all elevation angles exceeding 45° at two separate frequency subbands.

A third object of the present invention is to provide quadrifilar helix antenna capable of providing a good impedance match over a broad band of operating frequencies.

It is still a further object of the present invention to provide a quadrifilar helix antenna system for satellite and cellular phones that has a physically small feed structure and that minimizes the phase distortions introduced in the feed network.

These and other objects of the present invention are provided by physically small quadrifilar helix antenna systems which capitalize on the size, gain, polarization, and radiation pattern characteristics achievable with quadrifilar helix antennas, while avoiding the bandwidth limitations of such antennas, through the use of switched transmit and receive circuit branches which effectively change the electrical length of the elements of the quadrifilar helix antenna. These circuit branches allow the antenna to operate at resonance in separate transmit and receive frequency bands thereby permitting half-duplex communications over separate transmit and receive frequency bands. Additionally, antenna systems according to the present invention may also employ impedance matching networks to increase the operating bandwidth of the antenna in both the transmit and receive frequency subbands.

In a preferred embodiment of the present invention, a quadrifilar helix antenna is provided, which is associated with first and second circuit branches that include means for changing the resonant frequency of the quadrifilar helix antenna to first and second resonant frequencies. Also included are coupling means, which electrically connect the antenna to the transmitter and receiver, respectively. Further included are first and second disconnecting means for respectively electrically isolating the first and second circuit branches from the quadrifilar helix antenna. The quadrifilar helix antenna may comprise two bifilar helices arranged orthogonally and excited in phase quadrature. Moreover, this antenna system can be provided as a component of a handheld transceiver that further includes a transmitter, a receiver, and a user interface.

In another embodiment of the present invention, the coupling means may comprise transmit and receive 90° hybrid couplers, which preferably may be implemented as lumped elements. In this embodiment, the quadrifilar helix antenna comprises a first filar coupled at its origin to one of the output ports on both the transmit and receive 90° hybrid couplers, a second filar coupled at its origin to the other output ports on these 90° hybrid couplers, and third and fourth filars coupled at their origin to a first reference voltage. In this embodiment, the first and third filars and the second and fourth filars are electrically connected at their distal ends. Each of these filar helices may comprise a helix with a pitch angle from about 55 to 85 degrees.

In a further embodiment of the present invention, the coupling means comprises a single 90° hybrid coupler. In this embodiment, third disconnecting means may also be provided for electrically isolating the first circuit branch from the 90° hybrid coupler, and fourth disconnecting means may be provided for electrically isolating the second circuit branch from the 90° hybrid coupler.

The first circuit branch may comprise at least one inductor coupled in series with the bifilar helices of the quadrifilar helix antenna. These one or more inductors operate to change the resonant frequency of the quadrifilar helix antenna. Similarly, the second circuit branch may comprise at least one capacitor coupled in series with the bifilar helices of the quadrifilar helix antenna. These one or more capacitors similarly operate to change the resonant frequency of the quadrifilar helix antenna.

In a further aspect of the present invention, the means for isolating the respective first and second circuit branches may comprise a plurality of switching means interposed along the electrical connections between the quadrifilar helix antenna and the transmitter and receiver. Such switches could comprise PIN diodes, gallium arsenide field effect transistors, or other electrical, electrical mechanical, or mechanical switching mechanisms known to those of skill in the art.

Radio frequency baluns with a 4:1 impedance transformation may also be coupled to the origin of each antenna element. In other embodiments of the present invention, the antenna system further includes at least one microelectronic substrate, and the quadrifilar helix antenna, the coupling means, the first and second circuit branches and the first and second disconnecting means are implemented on the at least one microelectronic substrate.

In another aspect of the present invention, matching means are coupled to the elements of the quadrifilar helix antenna for increasing the operating bandwidth of the quadrifilar helix antenna. These matching means may be implemented as inductor-capacitor pi or ladder circuits.

Thus, the antenna systems of the present invention provide a quadrifilar helix antenna and switched circuit elements which allow the antenna to provide half-duplex communications over separate transmit and receive frequency bands. These antenna systems may further include matching means which increase the operating bandwidth of the antenna in both the transmit and receive frequency bands. These antenna systems further provide the gain, bandwidth, polarization, and radiation pattern characteristics necessary for emerging mobile satellite communications applications, in a physical package which is conveniently small and meets consumer expectations relating to ease of portability.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Additionally, while the antenna systems of the present invention are particularly advantageous for use in certain satellite communications applications, it will be understood by those of skill in the art that these antenna systems may be advantageously used in a variety of applications, including cellular, terrestrial based communications systems, and thus the present invention should not be construed as limited in any way to antenna systems for use with satellite communication terminal handsets. Like numbers refer to like elements throughout.

Figure 1:
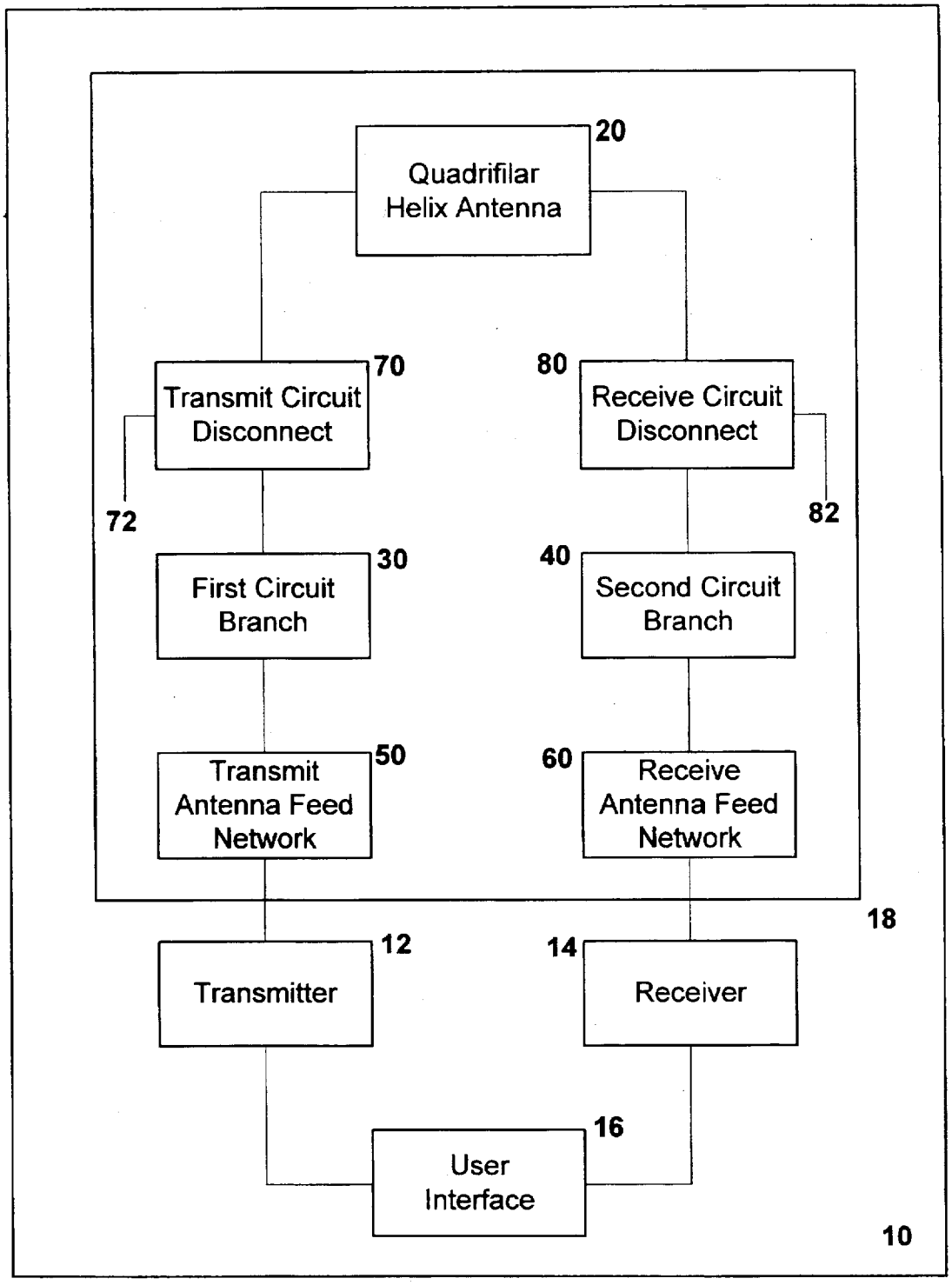
FIG. 1 is a block diagram of a quadrifilar helix antenna system according to the present invention.

An embodiment of a handheld wireless communications terminal 10 according to the present invention is depicted in the block diagram of FIG. 1. Terminal 10 generally comprises an antenna system 18, a transmitter 12, a receiver 14 and a user interface 16. User interfaces 16 suitable for use in handheld radio communications terminals are well known to those of skill in the art, such as microphones, keypads, rotary dials and the like. Similarly, a wide variety of transmitters 12 and receivers 14 which are suitable for use with a handheld radio communications terminal are also known to those of skill in the art. As illustrated in FIG. 1, the antenna system 18 of the handheld terminal also includes a quadrifilar helix antenna 20, transmit and receive circuit disconnect means 70, 80, first and second circuit branches 30, 40 and transmit and receive antenna feed networks 50, 60. Antenna system 18 provides for dual band, half-duplex wireless communications and is capable of meeting the stringent gain, bandwidth, radiation pattern and other requirements of emerging cellular/satellite phone applications.

As depicted in FIG. 1, quadrifilar helix antenna 20 may be electrically connected to transmit and receive circuit disconnect means 70, 80, which are typically implemented as switches. The transmit circuit disconnect means 70 operate to electrically isolate the transmit network 30, 50, 12 from the antenna 20 when the handset 10 is operating in receive mode. Similarly, the receive circuit disconnect 80 operates to electrically isolate the receive network 40, 60, 14 from antenna 20 during periods of transmission. Also provided are first and second circuit branches 30, 40 which are used to adjust the resonant frequency of the quadrifilar helix antenna 20. First circuit branch 30, is used to tune antenna 20 to a first resonance frequency which preferably corresponds to the center frequency of the transmit frequency band. Similarly, second circuit branch 40 is used to tune antenna 20 to a second resonance frequency which preferably corresponds to the center frequency of the receive frequency band. Thus, the first and second circuit branches 30, 40 allow a relatively narrowband quadrifilar helix antenna to operate at separate transmit and receive frequency bands by providing means for resonating the antenna at two separate frequencies. Antenna system 18 may further comprise transmit and receive antenna feed networks 50, 60, which operate to couple quadrifilar helix antenna 20 to transmitter 12 and receiver 14, respectively.

The antenna system depicted in FIG. 1 operates as follows. When the user handset 10 is in the receive mode, bias signal 72 is activated which activates the transmit circuit disconnect switches 70, thereby opening these switches to open-circuit the electrical connection between the transmit network 30, 50, 12 and quadrifilar helix antenna 20 in order to electrically isolate the transmit circuit branch 30, 50, 12 from the antenna 20. Similarly, when the user handset 10 is in the transmit mode, bias signal 82 is activated, which activates the receive circuit disconnect switches 80 in order to open these switches 80 to electrically isolate the receive network 40, 60, 14 from antenna 20. During periods of transmission, coupling means 50 feed a source signal from transmitter 12 to the quadrifilar helix antenna 20, whereas in receive mode coupling means 60 operate to combine the signal received by the elements of the quadrifilar helix antenna 20 and feeds this combined signal to receiver 14.

As will be understood by those of skill in the art, the switching means which are typically used to implement the transmit and receive circuit disconnects 70, 80 need not actually provide a true open circuit in order to effectively electrically isolate the antenna from the "off" network which is not in use; they need to provide sufficient impedance such that only a minimal amount of energy is coupled into the "OFF" network. Various means of providing such an "open circuit" are known to those of skill in the art, such as reverse biased PIN diodes, gallium arsenide field effect transistors, and various other electrical, electromechanical and mechanical switching mechanisms.

While FIG. 1 depicts the transmit and receive antenna feed networks 50, 60 and transmit and receive circuit disconnect means 70, 80 as separate devices, those of skill in the art will also understand that two or more of these functions may be combined in a single device such as a switched 90° hybrid coupler which both feeds signals from transmitter 12 to antenna 20 as well as feeds signals received by antenna 20 to receiver 14. Thus, while FIG. 1 depicts each of these functions as separate devices, the present invention also includes other embodiments which combine two or more of these functions in a single device.

Figure 2:
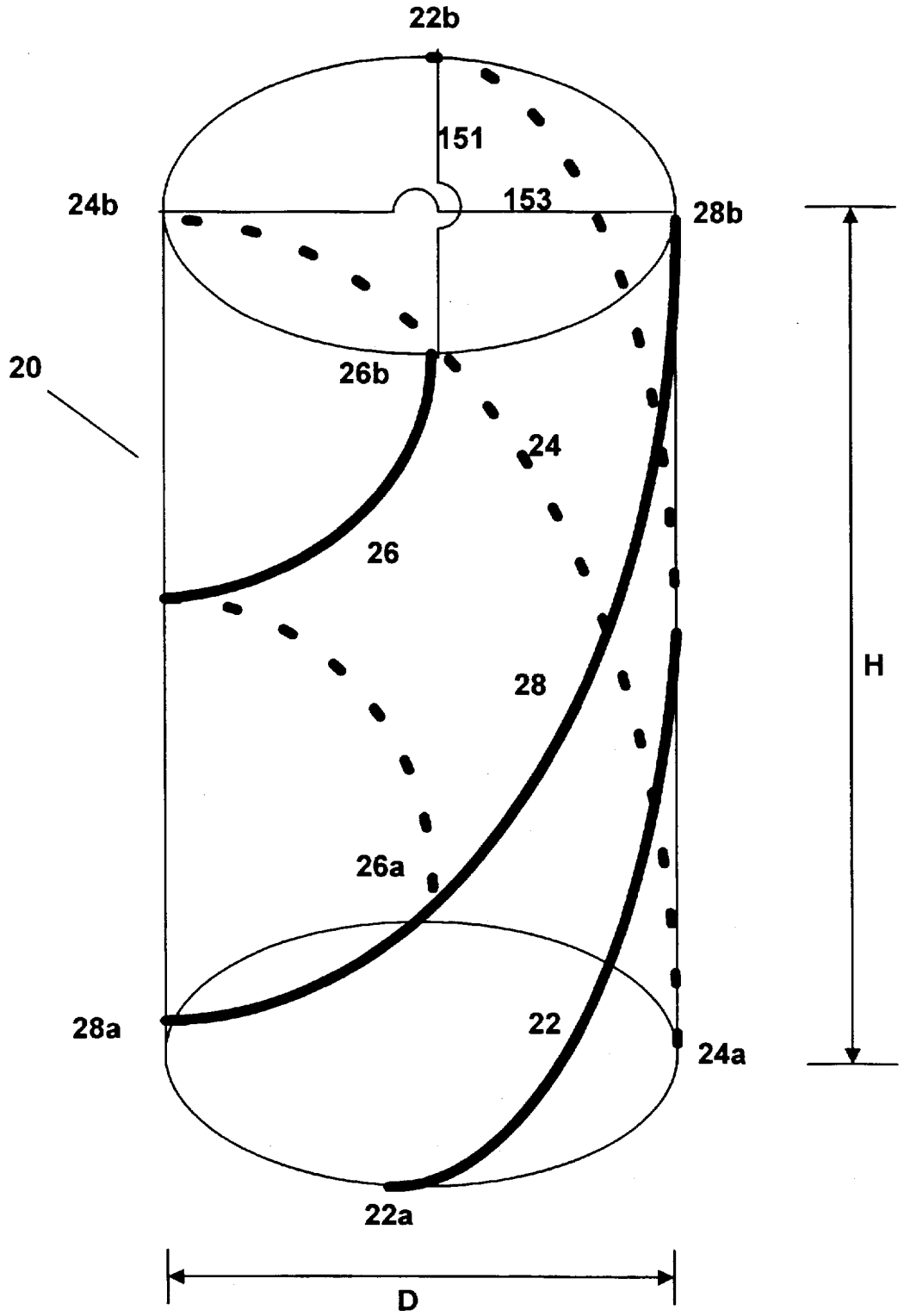
FIG. 2 is a perspective view of a quadrifilar helix antenna according to the present invention.

As illustrated in FIG. 2, quadrifilar helix antenna 20 is comprised of four radiating helical antenna elements 22, 24, 26, 28 or "filars". A filar is typically implemented as a wire or strip, such as 22, wrapped in a helical shape along the length of a coaxial supporting tube, thereby defining a cylinder of constant diameter D and axial length H. Thus, antenna 20 comprises a pair of bifilar helices, 22, 26 and 24, 28. In a preferred embodiment, the elements 22, 24, 26, 28 of quadrifilar helix antenna 20 are excited in phase quadrature and are physically spaced from each other by 90°. Moreover, where the elements are implemented as a strip of conducting material, preferably relatively wide strips (e.g., on the order of 3–5 millimeters wide for an antenna designed to operate in the 1500–1660 MHz frequency range) are used to reduce the loss and to minimize the inductance of the elements, thereby facilitating matching the impedance of antenna 20 to impedance of transmitter 12 and receiver 14.

Alternative embodiments within the scope of the present invention include a quadrifilar helix antenna 20 having radiating elements 22, 24, 26, 28 which are helical in the sense that they each form a coil or part coil around an axis, but also change in diameter from one end to the other. Thus, while the preferred embodiment of antenna 20 has helical elements defining a cylindrical envelope, it is possible to implement antenna 20 to have elements defining instead a conical envelope or another surface of revolution. Moreover, note that as used herein, it is intended that the word "helix" not imply a plurality of turns. In particular, a "helix" as used herein may constitute less than one full turn.

The twist of the individual helices 22, 24, 26, 28 may be right hand or left hand, where each element 22, 24, 26, 28 comprising antenna 20 has the same direction of twist. As the antenna 20 of the present invention typically is origin fed in endfire mode, by IEEE and industry conventions, a left hand twist is generally used to receive and transmit right hand circularly polarized waveforms, whereas a right hand twist generally is used to receive and transmit left hand circularly polarized waveforms.

The radiation pattern provided by quadrifilar helix antenna 20 is primarily a function of the helix diameter, pitch angle (which is a function of the number of turns per unit axial length of the helix) and element lengths. In a preferred embodiment of the present invention, the helical antenna elements 22, 24, 26, 28 are each approximately λ/2 in electrical length, where λ is the wavelength corresponding to a frequency falling somewhere between the frequencies which define the transmit and receive frequency subbands. In this embodiment, antenna 20 preferably has a pitch angle from about 55 to 85 degrees. In this preferred range, the lower pitch angles provide more hemispherical coverage, while the higher pitch angle values concentrate the radiation pattern (and hence provides greater directivity) over a smaller solid angle than hemispherical coverage for element lengths on the order of ½ wavelength. Given the specific requirements of the system in which the antenna is to be used, a judicious choice of pitch angle may be made to provide the optimum tradeoff between coverage and directivity. Quadrifilar helix antenna 20 preferably operates in standing wave mode, providing a quasi-hemispherical radiation pattern for a relatively narrow bandwidth about the resonant frequency.

Figure 3:
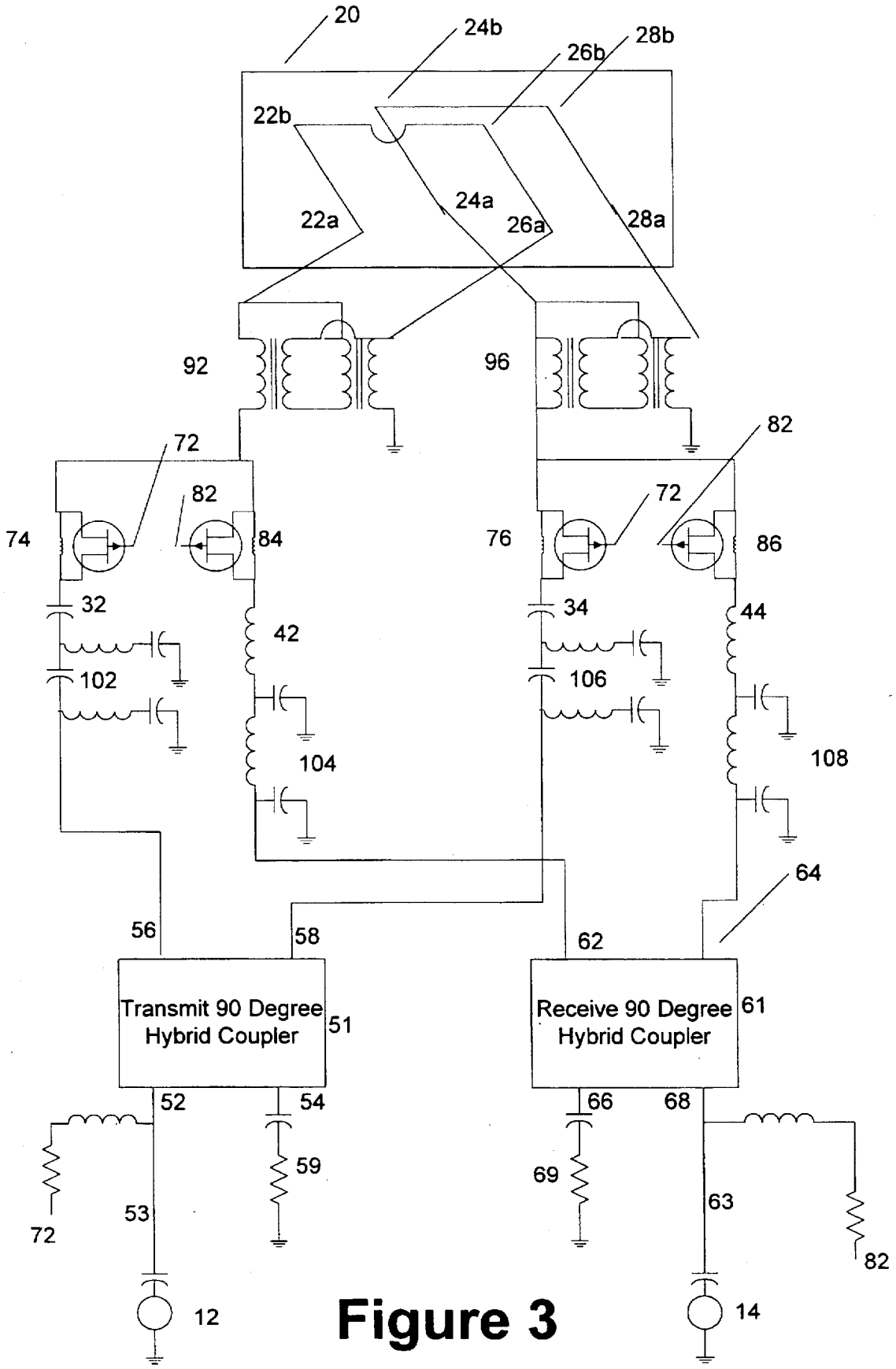
FIG. 3 is a schematic diagram illustrating specific embodiments of an antenna, coupling network, dual band operation network and impedance matching network of the present invention.

The four individual antenna elements 22, 24, 26, 28 that comprise quadrifilar helix antenna 20 each have an origin 22*a*, 24*a*, 26*a*, 28*a*, which is the end proximate the transmit and receive antenna feed networks 50, 60, and a distal end 22*b*, 24*b*, 26*b*, 28*b*. As indicated in FIGS. 1–3, the distal ends 22*b*, 26*b* of quadrifilar helix antenna elements 22 and 26 are preferably electrically connected by wire or strip 151 to form a bifilar loop, with the origin 22*a* of element 22 coupled to both the transmit and receive networks 30, 50, 12; 40, 60, 14 and the origin 26*a* of element 26 coupled to ground. Similarly, the distal ends 24*b*, 28*b* of elements 24 and 28 are preferably electrically connected by wire or strip 153 to form a second bifilar loop, with the origin 24*a* of element 24 connected to both the transmit and receive networks 30, 50, 12; 40, 60, 14 and the origin 28*a* of element 28 coupled to ground. This embodiment of quadrifilar helix antenna 20 is referred to as a closed loop embodiment, as the elements of antenna 20 are electrically connected at their distal ends. These are to be distinguished from open-loop quadrifilar helix antennas, which comprise four helical elements each of which is open-circuited at its distal end.

In a preferred embodiment of antenna 20, bifilar loops 22, 26; 24, 28 are symmetrical. Accordingly, electrical connections 151, 153 are preferably implemented as identically shaped conductive wires or strips arranged so as to provide the short-circuits which form bifilar loops 22, 26; 24, 28 while electrically isolating bifilar loop 22, 26 from bifilar loop 24, 28. Such a symmetrical arrangement of electrical connections 151, 153 minimizes the variation in phase between adjacent elements from the ideal phase offset of 90°. Quadrifilar helix antenna 20 may additionally include a radome. In the preferred embodiment, this radome is a plastic tube with an end cap.

The closed loop embodiment of the quadrifilar helix antenna 20 of the present invention may solve a problem that may arise when open loop quadrifilar helix antennas are used in mobile phone applications. Specifically, in applications which require a small antenna diameter, a bottom-fed ½ wavelength open loop quadrifilar helix antenna has a nearly open circuit impedance (1000 ohms or more) at the resonant frequency. Such an impedance may be too large to transform to the desired impedance, which is typically on the order of 50 ohms as the antenna typically is fed by a 50 ohm impedance coaxial cable, and thus maximum power transfer may not be obtained because the impedance of the antenna cannot be matched to the impedance of the source transmission line. In a preferred embodiment, the resonant resistance of the closed loop bottom-fed λ/2 length element quadrifilar helix antenna is in the region of 4–8 ohms when antenna 20 operates in receive mode and 8–12 ohms when antenna 20 operates in transmit mode. This may be transformed to the order of 50 ohms to match the impedance of the transmission source by various impedance transformation techniques, such as a radio frequency transformer or via impedance matching networks such as those discussed herein. However, for certain element lengths other than ½ wavelength, such as ¾ wavelength elements, the open circuit impedance may be much lower so as to be transformable to the order of 50 ohms.

Quadrifilar helix antennas are known to be capable of radiating right or left hand circularly polarized signals when fed from the top in a backfire mode, fed in the middle via a selectable up or down mode, or when bottom fed in a forward fire reverse twist mode. However, top fed versions may require sleeve baluns in the center of the cylindrical structure, which may be difficult to fabricate. This is particularly true at the microwave frequencies used in some satellite and cellular phone systems due to the small diameter of the helical antenna structure required by such phones. Similarly, center fed quadrifilar helical antennas may also be difficult to fabricate. In a preferred embodiment, this invention solves these fabrication problems by using an origin-fed network to the quadrifilar helix antenna which drives two closed bifilar loops.

The elements 22, 24, 26, 28 of quadrifilar helix antenna 20 are preferably comprised of a continuous strip of electrically conductive material such as copper. In a preferred embodiment, these radiating elements 22, 24, 26, 28 are printed on a flexible, planar dielectric substrate such as fiberglass, TEFLON, polyimide or the like, and the radiating elements 22, 24, 26, 28 are disposed on the dielectric base via etching, deposition or other conventional methods. This flexible dielectric base is then rolled into a cylindrical shape, thereby converting the linear strips into helical antenna elements 22, 24, 26, 28. However, while the technique of forming a quadrifilar helix antenna described above is the preferred method, it will be readily apparent to those of skill in the art that quadrifilar helix antenna 20 may be implemented in a variety of different ways, and that a cylindrical support structure is not even required.

In the embodiment of the present invention depicted in FIG. 2, quadrifilar helix antenna 20 comprises four copper strips 22, 24, 26, 28 wound less than a full turn on a fiberglass tube. The length of each element preferably is ½ the wavelength corresponding to a frequency somewhere between the lowest frequency in the 1525 MHz to 1559 MHz receive frequency band and the highest frequency in the 1626.5 MHz to 1660.5 MHz transmit frequency band. However, in light of the present disclosure, it will be understood by those of skill in the art that the present invention can be implemented with λ/2 length antenna elements 22, 24, 26, 28 where λ corresponds to a frequency falling below the lower, or above the higher, of the transmit and receive frequency bands. Moreover, as will be understood by those of skill in the art, the antenna elements may also be of approximately λ/4, 3 λ/4 or λ in length or any other length which will provide for resonance operation. Furthermore, as will also be understood by those of skill in the art, the actual physical length of the antenna may be appreciably shortened due to radome effects, as the radome tends to change the velocity of propagation such that the length is shorter than in free space. Such an effect is advantageous where smaller size is an important goal, and thus it will be understood that quadrifilar helix antenna systems of the present invention may also be operated at or near resonance with antenna elements of other physical lengths.

Moreover, while quadrifilar helix antennas with elements of actual or electrical (where radome effects apply) length $\lambda/4$, $\lambda/2$, $3\lambda/4$ and $\lambda$ are known to operate at resonance, such resonant or near resonant operation may also be obtained with elements of other lengths. Resonant operation implies that the equivalent reactance is zero while the equivalent immittance is a real value. Operation at resonance is desirable, because at resonance maximum power transfer may be accomplished without any further reactive matching. However, as will be understood by those of skill in the art, through the use of additional matching means it is possible to design a quadrifilar helix antenna with element lengths which are not a multiple of a quarter wavelength that operates at or near resonance, thereby providing for good power transfer between the source and the load. Accordingly, it should be recognized that the present invention is not limited to quadrifilar helix antennas with element lengths which are multiples of a quarter wavelength, but instead encompasses quadrifilar helix antennas with any element lengths which, in conjunction with any matching structure, provide for nearly resonant operation.

As indicated in FIG. 1, transmit and receive antenna feed networks 50, 60 are provided to phase split the energy for radiation in the transmit mode and for combining the received radiated energy in receive mode. These feed networks 50, 60 can be implemented as any of a variety of known networks for feeding a quadrifilar helix antenna, such as the combination of a hybrid coupler and two symmetrizer modules disclosed in U.S. Pat. No. 5,255,005 to Terret et al.

A preferred embodiment of the antenna system of the present invention is illustrated in FIG. 3. In this embodiment, each of the feed networks 50, 60 is implemented as a 90° 3 dB hybrid coupler 51, 61. Each of these 90° hybrid couplers 51, 61 is coupled to the bifilar loops which form quadrifilar helix antenna 20.

As illustrated in FIG. 3, 90° hybrid coupler 51 has inputs 52, 54 and outputs 56, 58. Input 52 is coupled to the transmission signal source 12 through coaxial cable 53 and input 54 is coupled to ground through a resistive termination 59. As illustrated best in FIG. 3, in a preferred embodiment, transmit 90° hybrid coupler 51 divides the input source signal from transmitter 12 into two, equal amplitude output signals, which are offset from each other by 90° in phase. The signal fed through output port 56 is coupled to the first of the two $\lambda$ long bifilar loops 22, 26 which comprise quadrifilar helix antenna 20, and the signal fed through output port 58 feeds the second $\lambda$ long bifilar loop 24, 28.

As also is illustrated in FIG. 3, the receive feed network is preferably implemented in a manner similar to the transmit feed network, except that the receive feed network is used to combine and deliver induced power from antenna 20 to receiver 14 as opposed to delivering a signal to the antenna 20 for radiation. Accordingly, a receive 90° hybrid coupler 61 having input ports 62, 64 and output ports 66, 68 is used to combine the energy received by quadrifilar helix antenna 20 and deliver this induced power to receiver 14. Input port 62 of the receive 90° hybrid coupler 61 is coupled to the first bifilar loop 22, 26 of quadrifilar helix antenna 20, and input port 64 is coupled to the second bifilar loop 24, 28. Output 68 of the receive 90° hybrid coupler is coupled to receiver 14 through a coaxial cable 63, and output port 66 is coupled to ground through resistor 69.

Moreover, the use of 90° hybrid couplers 51, 61 also facilitates in reducing the effective VSWR seen by transmitter 12 and receiver 14, thereby both improving the link margin and increasing the operating bandwidth over which the antenna may be used. This occurs because these 90° hybrid couplers combine the energy incident at the 0° and 90° ports in such a way as to present the desired signal at the input port of the 90° hybrid coupler while absorbing the reflected signals in the resistive termination. Accordingly, the VSWR measured at transmitter 12 and receiver 14 is only a very minimal portion of the VSWR measured at the ports of the 90° hybrid couplers proximate antenna 20.

As will be readily understood by those of skill in the art, 90° hybrid couplers 51 and 61 can be implemented in a variety of different ways, such as distributed quarter-wave length transmission lines or as lumped element devices. In a preferred embodiment, lumped element 90° hybrid splitter/combiners mounted on a stripline or microstrip electronic substrate are used as they can maintain a phase difference of almost exactly 90° between their respective output ports. Distributed quarter wavelength branch line couplers or other arrangements utilizing transmission lines, on the other hand, only maintain a 90° phase difference between the output ports at frequencies near resonance. Thus, for example, given a 34 MHz transmit or receive frequency band in the L-Band frequency range, distributed branch line couplers may result in as much as 4° in phase offset between signals at the center versus signals at the upper and lower ends of the 34 MHz frequency band.

FIG. 3 also illustrates a preferred method of electrically coupling quadrifilar helix antenna 20 to the respective transmit and receive feed networks 50, 60. As discussed above, in a preferred embodiment quadrifilar helix antenna 20 is implemented as a pair of wavelength ($\lambda$) long, short circuited, bifilar loops. As shown in FIG. 3, antenna 20 is fed by coupling $\lambda$ long loop 22, 26 to the 0° inputs 56, 62 of the respective transmit and receive 90° hybrid couplers 51, 61 and coupling the second bifilar loop 24, 28 to the 90° inputs 58, 64 of the respective 90° hybrid couplers 51, 61. Thus, the origins **22*a*, 24*a* of elements 22, 24 are coupled to both the transmit and receive antenna feed networks, while the origins 26*a*, 28*a* of elements 26, 28 of the quadrifilar helix antenna 20 are coupled to electrical ground. In this manner, during transmission each element 22, 24, 26, 28 of quadrifilar helix antenna 20, is excited in phase quadrature by equal amplitude signals, as a signal incident at the origin 22*a*, 24*a* of either of the $\lambda$ long bifilar loops 22, 26; 24, 28 undergoes a 180° phase change in traversing the length of the loop to the respective terminations 26*a*, 28*a***.

As illustrated in FIG. 1, the antenna systems according to the present invention also preferably include first and second circuit branches 30, 40. These circuit branches 30, 40 are used to adjust the resonant frequency of quadrifilar helix antenna 20 to allow the antenna 20 to resonate at a minimum of two separate frequencies. Specifically, the first circuit branch 30 may be used to change the resonant frequency of antenna 20 to correspond to approximately the center frequency of a transmit frequency subband, while the second circuit branch 40 similarly may be used to change the resonant frequency of the antenna 20 to correspond to approximately the center frequency of a receive frequency subband. Thus, by providing separate transmit and receive circuit branches which effectively change the resonant frequency of quadrifilar helix antenna 20, a quadrifilar helix antenna system capable of supporting mobile communications applications which use separate transmit and receive frequency subbands is provided.

As illustrated in FIG. 3, in a preferred embodiment of the present invention, first and second circuit branches 30, 40 may be implemented as reactive elements which are coupled to the elements 22, 24, 26, 28 of quadrifilar helix antenna 20 to thereby change the effective electrical length of these antenna elements. By way of background, an equivalent circuit of a closed loop element pair within a quadrifilar helix antenna can be formed by a series resistor, inductor and capacitor with a shunt capacitance across the series resistor, inductor and capacitor. Accordingly, the resonant frequency of each element is the resonant frequency associated with the equivalent series resistor-inductor-capacitor network, where the shunt capacitance causes the equivalent series reactance to be lower in the lower frequency band and higher in the higher frequency band. Thus, placing an additional reactive component (e.g., another capacitor or inductor) in series in a circuit branch coupled to one of these antenna elements, the resonant frequency of the element may be effectively changed to a different frequency.

As illustrated in FIG. 3, first circuit branch 30 may be implemented as capacitors 32, 34 which are electrically connected between output 56 of transmit 90° hybrid coupler 51 and λ long bifilar loop 22, 26 and output 58 and λ long bifilar loop 24, 28, respectively. These capacitors 32, 34 effectively shorten the electrical length of bifilar loops 22, 26; 24, 28 and thus tune antenna 20 to a higher resonant frequency. Similarly, second circuit branch 40 may be implemented as inductors 42, 44 which are electrically connected between bifilar loops 22, 26; 24, 28 and the respective inputs 62, 64 to receive 90° hybrid coupler 61. These inductors 42, 44 effectively lengthen the electrical length of antenna elements 22, 24, 26, 28 and thus tune antenna 20 to a lower resonant frequency.

As will be understood by those of skill in the art, first and second circuit branches 30, 40 need not be implemented as a pair of capacitors 32, 34 or inductors 42, 44, but instead may be implemented as any combination of reactive elements that effectively change the electrical length of antenna elements 22, 24, 26, 28. Accordingly, various combinations of capacitors and inductors which are electrically coupled between the transmit and receive antenna feed networks 50, 60 and the elements of quadrifilar helix antenna 20 may be used to implement first and second circuit branches 30, 40.

As illustrated in FIG. 3, both the transmit and receive antenna feed networks 50, 60 are coupled to bifilar loops 22, 26; 24, 28. Accordingly, it is possible that received energy may be coupled into the transmit circuit branch 30, 50, 12 or that energy induced into the antenna 20 from the transmitter 12 may be coupled into the receive circuit branch 40, 60, 14. Such coupling may be undesirable because it reduces the power that is transferred to the antenna 20 for transmission or that is transferred to the receiver 14 when the communications handset 10 operates in receive mode.

While the reactive elements 32, 34; 42, 44 of the first and second circuit branches typically help isolate the transmit circuit branch 30, 50, 12 when the antenna system is operating in receive mode, and the receive circuit branch 40, 60, 14 during periods of transmission, the isolation may not be sufficient in some cellular and satellite phone applications. Accordingly as illustrated in FIG. 1, antenna systems according to the present invention may further include transmit and receive circuit disconnect means 70, 80 which are used to effectively electrically isolate the "OFF" circuit branch by providing an open-circuit between the antenna 20 and the "OFF" circuit branch (note that the "OFF" circuit branch refers to the transmit circuit branch when the half-duplex user terminal is operating in receive mode, and refers to the receive circuit branch when the terminal is operating in transmit mode). When such an open-circuit is provided, the "ON" circuit branch essentially operates as if the "OFF" circuit branch was not present. In the preferred embodiment of the present invention depicted in FIG. 3, these open circuits are provided via switching means 74, 76; 84, 86 which are coupled to each of the bifilar loops 22, 26; 24, 28 of quadrifilar helix antenna 20. Switches 74, 76 are opened by bias signal 72 to provide an open circuit at the origins **22*a*, 26*a* of the bifilar loops when the user terminal 10 is in the receive mode, and switches 84, 86 are opened by bias signal 82 to provide an open circuit at the origins 22*a*, 26*a* of the bifilar loops when the user terminal 10** is in the transmit mode.

As will be understood by those of skill in the art, switching means 74, 76; 84, 86 can be provided by various electrical, electromechanical, or mechanical switches. However, electrical switches are preferred, due to their reliability, low cost, small physical volume and ability to switch on and off at the high speeds required by emerging digital communications modes of operation. These electrical switches can readily be implemented as small surface mount devices on the stripline or microstrip printed circuit board that contains the transmit and receive antenna feed networks 50, 60. In one embodiment of the present invention, switching means 74, 76; 84, 86 are implemented as PIN diodes.

A PIN diode is a semiconductor device that operates as a variable resistor over a broad frequency range from the high frequency band through the microwave frequency bands. These diodes have a very low resistance, of less than 1 ohm, when in a forward bias condition. Alternatively, these diodes may be zero or reverse biased, where they behave as a small capacitance of approximately one picofarad shunted by a large resistance of as much as 10,000 ohms. Thus, in forward bias mode, the PIN diode acts as a short-circuit, while in reverse bias mode, the PIN diode effectively acts as an open-circuit. In one embodiment of the present invention, switches 74, 76; 84, 86 are implemented as discrete PIN diodes mounted on a stripline or microstrip printed circuit board which are coupled to the origins **22*a*, 26*a* of the bifilar loops that comprise quadrifilar helix antenna 20**.

In this embodiment, when communications handset 10 is in receive mode, a D.C. bias current is applied to each PIN diode in the transmit circuit branch where it reverse biases these diodes thereby creating an open circuit at the origin of elements 22, 26 of quadrifilar helix antenna 20. At the same time, a forward control current is applied to the PIN diodes in the receive circuit branch creating a lower resistance connection to the receive circuit branch. Consequently, the receive circuit branch PIN diodes operate in forward bias mode, thereby coupling antenna 20 to receiver 14. As will readily be understood by those of skill in the art, when the user terminal 10 is operating in transmit mode, a reverse control voltage is applied to the PIN diodes in the receive circuit branch and a forward bias is applied to the PIN diodes in the transmit circuit branch, thereby coupling antenna 20 to the transmitter 12 and creating an open-circuit between quadrifilar helix antenna 20 and receive circuit branch 40, 60, 14.

In a preferred alternative embodiment, shown in FIG. 3, Gallium arsenide field effect transistors (GaAs FETs) are used instead of PIN diodes to implement switches 74, 76; 84, 86. These devices may be preferred over PIN diodes because they operate in reverse bias mode when a bias signal is absent, thereby avoiding the power drain inherent with PIN diodes which require a bias current for forward bias operation. Moreover, as shown in FIG. 3, each GaAs FET uses an inductor to anti-resonate and therefore isolate the switch in the "OFF" mode. This operation significantly increases the electrical isolation of the "OFF" circuits. In the "ON" mode, the inductor is rendered desirably ineffective as it is shorted by the "ON" resistance of the associated GaAs FET. Furthermore, the drains and sources of the GaAs FET switches are operated at direct current ground potential and resistance. This attribute renders these GaAs FET free from ordinary electrostatic discharge concerns typically associated with use of GaAs FETs near antenna circuitry. Moreover, in the embodiment of FIG. 3, a pair of radio frequency GaAs FET switches are used in both the transmit and receive modes, as the circuit arrangement is such that two switches are coupled to each of the bifilar loops 22, 26; 24, 28. Accordingly, the power handled by each switch 74, 76, 84, 86 is only half the power which would be required if a single switch was used to isolate each of the separate circuit branches. This is significant because currently available GaAs FETs have a power level above which undesired signal compression can occur, and the embodiment of FIG. 3 reduces the possibility of this occurring by requiring that only half the power pass through each GaAs FET switch 74, 76, 84, 86. In this embodiment, the GaAs FET switches 74, 76, 84, 86 are implemented as surface mount components on the stripline printed circuit board containing the transmit and receive 90° hybrid couplers 51, 61.

As illustrated in FIG. 3, typically, the transmission signal source 12 is coupled to the transmit 90° hybrid coupler 51 through a coaxial cable 53. Coaxial cable typically has an impedance of approximately 50 ohms. In order to maximize the energy transfer from transmission signal source 12 to quadrifilar helix antenna 20, it is preferable to match the impedance of the transmission source 12 and the impedance of the antenna 20. In the case where the transmission source 12 is coupled to the antenna 20 via 50 ohm coaxial cable, such matching can be accomplished by using known techniques to raise the impedance of antenna elements 22, 24 to approximately 50 ohms, and implementing resistor 59 as a 50 ohm resistor. As the $\lambda/2$ length antenna elements 22, 24, 26, 28 implemented in a preferred embodiment of the present invention have a resistance of approximately 4–12 ohms at resonance, an impedance transformation of approximately a factor of four is necessary to match the impedance of the quadrifilar helix antenna 20 to the impedance at the input of the transmit 90° hybrid coupler 51.

As illustrated in FIG. 3, such an impedance transformation may be provided by radio frequency baluns 92, 96 which include four to one transformers. As will be understood by those of skill in the art, such a balun may be implemented as $\lambda/4$ coaxial balun with a 4:1 impedance transformation or by various other balun implementations. By implementing impedance transformation means 92, 96 as coaxial 4:1 baluns, it is possible to transform the impedance of each antenna element 22, 24, 26, 28 to approximately 50 ohms to match the impedance of the transmitter 12 and receiver 14 sources. However, while a coaxial 4:1 balun is one potential method of implementing devices 92, 96, those of skill in the art will recognize that there are a variety of techniques which can be used to accomplish this impedance transformation, such as the use of a variety of small surface mount radio frequency transformers or ferrite core transformers, or through modifications to the impedance matching networks discussed below.

Additionally, as illustrated in FIG. 3, the antenna systems of the present invention may also include bandpass circuits 102, 104, 106, 108 for increasing the bandwidth over which the antenna system 18 will operate with a voltage standing wave ratio below some specified level. Such impedance matching is possible because the radiation pattern associated with antenna 20 on the mobile cellular and satellite phone system user terminal 10 generally does not require that the driving point impedance be resonant, but instead only requires that a reasonable conjugate match be provided between antenna system 18 and transmitter 12 or receiver 14. Thus, according to the principles of what has become known as "Fano's Law" and which are generally outlined in R.M. Fano, "*Theoretical Limitations on the Broadband Matching of Arbitrary Impedance*," J. Franklin Inst., February, 1950, pp. 139–154, impedance matching circuits may be employed to increase the bandwidth over which the impedance of antenna system 18 and transmitter 12 or receiver 14 are matched in the sense that the VSWR is maintained below a specified level.

By way of example, a quadrifilar helix antenna of the dimensions required by the Asian Cellular Satellite System has a near resonant resistance at the center of the transmit and receive frequency bands, but has a very high series equivalent reactance at the low and high ends of each 34 MHz frequency band. As such, the natural operating bandwidth of such an antenna (which is specified as the bandwidth for which the VSWR at the output of transmitter/receiver 12/14, is less than 1.5) is 1% or less of the carrier frequency, and hence in the Asian Cellular Satellite System, is on the order of 15 MHz or less in both the transmit and receive frequency bands. Accordingly, matching structures are required if such a quadrifilar helix antenna is to be used with that system.

As will be understood by those of skill in the art, a variety of different matching networks may be employed to provide improved broadband impedance matching. Generally, computer aided design techniques are used to derive an optimum topology for the impedance matching network and to determine component values, as discussed in William Sabin, *Broadband HF Antenna Matching with ARRL Radio Designer*, QST *MAGAZINE*, August, 1995, pp. 33–36.

As illustrated in FIG. 3, in a preferred embodiment of the present invention, impedance matching structures 104, 108 are implemented as pi networks that include a capacitor in each shunt leg. Similarly, impedance matching structures 102, 106 may be implemented as bandpass ladder networks that use a series inductor and capacitor in each shunt leg. Such an arrangement is preferred as the value of the inductors included in these circuits which optimize the broadband performance of antenna 20 may be sufficiently small such that low-cost off-the-shelf-components are not available which will guarantee an inductance in the desired range. However, since the impedance across the branch of a network consisting of a series inductor and capacitor is the sum of the positive reactance of the inductor and the negative reactance of the capacitor, the bandpass networks in this preferred embodiment allow the use of low-cost, off-the-shelf, larger value inductors which are effectively reduced by the series capacitance. By way of example, if a reactance of +J10 is desired at 1.6 GHz, a one nanohenry coil would be required, but a one nanohenry coil may be prohibitively expensive for some applications. However, the same effect can be accomplished by using a cheaper, off-the-shelf three nanohenry coil providing +J30 ohms reactance in series with a capacitor of −J20 ohms reactance or about 5 picofarads.

While the ladder network implementation depicted in FIG. 3 is preferred in various applications, those of skill in the art will understand that a wide variety of impedance matching networks may be used to improve the broadband performance of antenna system 18, and thus the present invention is not limited to the networks depicted in FIG. 3, as other implementations may be used to implement impedance matching circuits 102, 104, 106, 108. As will be understood by those of skill in the art, radio frequency transformers 92, 96, while not required also may help solve component realization problems since by increasing the resonant resistance of antenna elements 22, 24, 26, 28 from 4–12 ohms to approximately 50 ohms, the inductance values are effectively raised by a factor of four, further helping to solve potential component realization problems.

In a preferred embodiment of the present invention, the 90° hybrid couplers 51, 61, 50 ohm resistors 59, 69, GaAs FET switches 74, 76, 84, 86, impedance matching circuits 102, 104, 106, 108, first and second circuit branches 32, 34, 42, 44 and balun-transformers 92, 96 are all implemented as surface mount components on a stripline or microstrip printed circuit board. Preferably, a multilayer board is used which includes a ground circuit between its top and bottom layers, and the components of the 0° legs of the transmit and receive branch are mounted on one side of the board while the components of the 90° legs of the transmit and receive branch are mounted on the opposite side of the printed circuit board. At one end of the printed circuit board, four contacts are provided to couple the elements of quadrifilar helix antenna 20 to the feed circuitry. On the other end of the printed circuit board, provision is made for attaching the coaxial transmission lines from the transmitter 12 and receiver 14.

In a preferred embodiment, a flexible microelectronic substrate is employed, which is meandered to fit completely within the cylindrical structure which houses quadrifilar helix antenna 20. As discussed above, quadrifilar helix antenna 20 may also be implemented on a planar substrate which is similarly rolled to form the helical antenna elements 22, 24, 26, 28. The planar substrate on which antenna 20 is formed in this embodiment may be the same substrate that includes the components of the antenna feed network or may be a separate substrate which is electrically connected to the first substrate.

Moreover, by implementing antenna system 18 on one or more microelectronic substrates that are completely contained within the housing for the antenna, it is possible to place the antenna feed and matching networks in extremely close proximity to quadrifilar helix antenna 20, thereby minimizing the amount of stray inductance added by the electrical connections between such matching/feed networks and antenna 20. Preferably, all the elements of the feed circuits, matching circuits and other non-antenna components of antenna system 18 are positioned less than 5 centimeters from the origin of antenna 20. More preferably, these components are positioned less than 3 centimeters from the origin of antenna 20.

Figure 4:
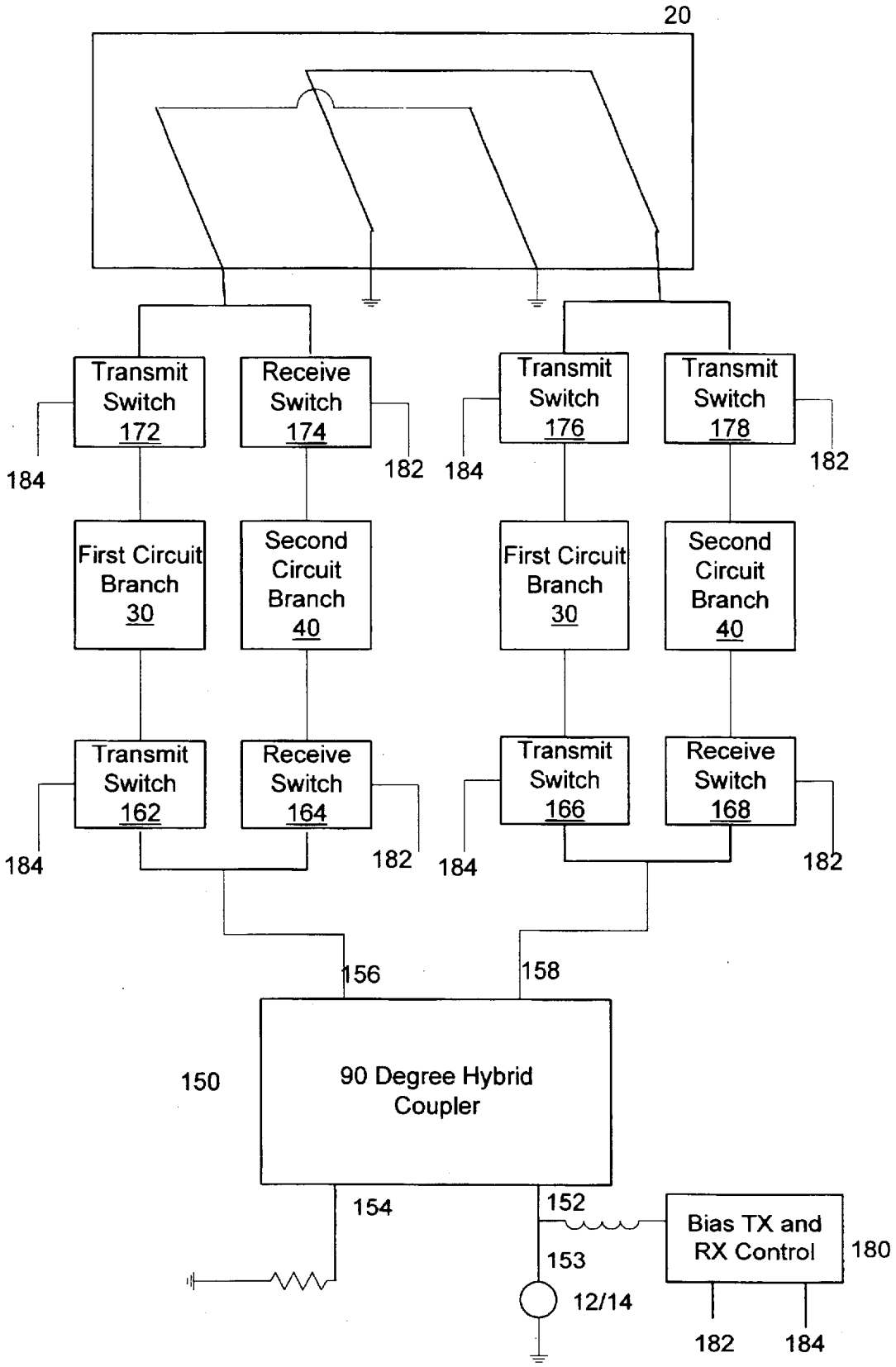
FIG. 4 is a schematic diagram illustrating another embodiment of the antenna systems according to the present invention.

An alternative embodiment of the antenna feed network is illustrated in FIG. 4. In this embodiment, a single 90° hybrid coupler 150 is used in conjunction with switching means 162, 164, 166, 168; 172, 174, 176, 178 to provide for dual band communications. As illustrated in FIG. 4, 90° hybrid coupler 150 is coupled to both the transmitter 12 and receiver 14 through input 152. Input 154 of 90° hybrid coupler is coupled to a resistive termination. Outputs 156, 158, are coupled to switching means 162, 164, 166, 168; 172, 174, 176, 178. Thus in this embodiment, only a single 90° hybrid coupler 150 is required, which operates with switching means 162, 164, 166, 168 to feed antenna 20, and this hybrid coupler 150 may be connected to transmitter 12 receiver 14 through a single coaxial cable 153.

The feed network illustrated in FIG. 4 operates as follows. During periods of transmission, transmitter 12 couples the signal to be transmitted to 90° hybrid coupler 150, which divides the source signal into two equal amplitude output signals, which are offset from each other by 90° in phase. output 156 couples the signal to switches 162, 164 and output 158 couples the signal to switches 166, 168. Bias control mechanism 180 sends out bias signal 182, which excites switches 164, 168, 174, 178 thereby open-circuiting those switches. At the same time, switches 162, 166, 172, 176 remain closed (short-circuited) thereby allowing the signal to be transmitted to pass through the remaining circuitry in the transmit branch for transmission by antenna 20. As will be understood by those of skill in the art, the embodiment illustrated in FIG. 4 works essentially the same way when in receive mode, except that bias control mechanism 180 activates bias signal 184, which in turn open-circuits switches 162, 166, 172, 176 instead of switches 164, 168, 174, 178.

In the drawings, specification and examples, there have been disclosed typical preferred embodiments of the invention and, although specific terms are employed, these terms are used in a generic and descriptive sense only and not for purposes of limitation, the scope of the invention being set forth in the following claims. Accordingly, those of skill in the art will themselves be able to conceive of embodiments of the antenna system other than those explicitly described herein without going beyond the scope of the present invention.

That which is claimed is:

1. An antenna system for providing electrical signals to a receiver and for transmitting electrical signals from a transmitter, comprising:

(a) a quadrifilar helix antenna;

(b) first circuit branch means for changing the resonant frequency of said quadrifilar helix antenna to a first resonant frequency;

(c) second circuit branch means for changing the resonant frequency of said quadrifilar helix antenna to a second resonant frequency;

(d) coupling means for coupling the signal from said quadrifilar helix antenna to said receiver and for coupling the signal from said transmitter to said quadrifilar helix antenna;

(e) first disconnecting means for electrically isolating said first circuit branch from said quadrifilar helix antenna; and (f) second disconnecting means for electrically isolating said second circuit branch from said quadrifilar helix antenna.

2. The antenna system of claim 1, wherein said coupling means comprises first coupling means for coupling the signal from said transmitter to said quadrifilar helix antenna and second coupling means for coupling the signal from said quadrifilar helix antenna to said receiver.

3. The antenna system of claim 2, wherein said first coupling means comprises a transmit 90° hybrid coupler having two input ports and wherein said second coupling means comprises a receive 90° hybrid coupler having two output ports.

4. The antenna system of claim 3, wherein said quadrifilar helix antenna comprises a first filar coupled at its origin to both the first output port on said transmit 90° hybrid coupler and the first input on said receive 90° hybrid coupler, a second filar coupled at its origin to both the second output port of said transmit 90° hybrid coupler and the second input of said receive 90° hybrid coupler, and third and fourth filars coupled at their origin to a first reference voltage, and wherein said first and third filars are electrically connected at their distal ends and said second and fourth filars are electrically connected at their distal ends.

5. The antenna system of claim 3, wherein said transmit and receive 90° hybrid couplers comprise lumped element 90° hybrid couplers.

6. The antenna system of claim 1, wherein said first circuit branch means and said second circuit branch means comprise reactive elements to thereby change the resonant frequency of said quadrifilar helix antenna.

7. The antenna system of claim 1, wherein said first circuit branch means comprises at least one inductor coupled in series with the elements of said quadrifilar helix antenna.

8. The antenna system of claim 7, wherein said second circuit branch means comprises at least one capacitor coupled in series with the elements of said quadrifilar helix antenna.

9. The antenna system of claim 1, wherein said first disconnecting means comprises a plurality of switching means interposed along each electrical connection between said transmitter and said quadrifilar helix antenna and wherein said second disconnecting means comprises a plurality of switching means interposed along each electrical connection between said receiver and said quadrifilar helix antenna.

10. The antenna system of claim 9, wherein said switching means comprise gallium arsenide field effect transistors.

11. The antenna system of claim 9, wherein said switching means comprise PIN diodes.

12. The antenna system of claim 1, further comprising two radio frequency baluns, wherein one of said baluns is coupled to the origin of each antenna element.

13. The antenna system of claim 12, wherein said baluns further provide a 4:1 impedance transformation.

14. The antenna system of claim 1, wherein said quadrifilar helix antenna comprises two bifilar helices arranged orthogonally and excited in phase quadrature.

15. The antenna system of claim 14, wherein each of said filar helices comprises a helix with a pitch angle greater than about 55 degrees and less than about 85 degrees.

16. The antenna system of claim 1, further comprising at least one microelectronic substrate, and wherein said quadrifilar helix antenna, said coupling means, said first circuit branch, said second circuit branch, said first disconnecting means and said second disconnecting means are implemented on said at least one microelectronic substrate.

17. The antenna system of claim 1, further comprising matching means coupled to the elements of said quadrifilar helix antenna for increasing the operating bandwidth of said quadrifilar helix antenna.

18. The antenna system of claim 17, wherein said matching means comprise inductor-capacitor ladder circuits.

19. The antenna system of claim 1, further comprising third disconnecting means for electrically isolating said first circuit branch from said coupling means and fourth disconnecting means for electrically isolating said second circuit branch from said coupling means.

20. The antenna system of claim 19, wherein said third disconnecting means comprises a plurality of switching means interposed along each electrical connection between said transmitter and said first circuit branch and wherein said fourth disconnecting means comprises a plurality of switching means interposed along each electrical connection between said receiver and said second circuit branch.

21. The antenna system of claim 20, wherein said switching means comprise gallium arsenide field effect transistors.

22. The antenna system of claim 20, wherein said switching means comprise PIN diodes.

23. The antenna system of claim 19, wherein said coupling means comprises a 90° hybrid coupler which is electrically connected to said transmitter and said receiver via a single coaxial cable.

24. A half-duplex antenna system for providing electrical signals to a receiver and for transmitting electrical signals from a transmitter, comprising:

(a) a quadrifilar helix antenna comprising two bifilar helices arranged orthogonally and excited in phase quadrature;

(b) a receive 90° hybrid coupler;

(c) a plurality of switching means interposed along each electrical connection between said receiver and said quadrifilar helix antenna;

(d) a transmit 90° hybrid coupler;

(e) a plurality of switching means interposed along each electrical connection between said transmitter and said quadrifilar helix antenna; and (f) matching means coupled to the elements of said quadrifilar helix antenna for increasing the operating bandwidth of said quadrifilar helix antenna.

25. The antenna system of claim 24, wherein said matching means comprise inductor-capacitor ladder circuits.

26. The antenna system of claim 24, further comprising first circuit branch means for changing the resonant frequency of said quadrifilar helix antenna to a first resonant frequency and second circuit branch means for changing the resonant frequency of said quadrifilar helix antenna to a second resonant frequency.

27. The antenna system of claim 26, wherein said first circuit branch means comprises at least one inductor coupled in series with the elements of said quadrifilar helix antenna.

28. The antenna system of claim 27, wherein said second circuit branch means comprises at least one capacitor coupled in series with the elements of said quadrifilar helix antenna.

29. The antenna system of claim 24, wherein said quadrifilar helix antenna comprises a first filar coupled at its origin to both the first output port on said transmit 90° hybrid coupler and the first input on said receive 90° hybrid coupler, a second filar coupled at its origin to both the second output port of said transmit 90° hybrid coupler and the second input on said receive 90° hybrid coupler, and third and fourth filars coupled at their origin to a first reference voltage, and wherein said first and third filars are electrically connected at their distal ends and said second and fourth filars are electrically connected at their distal ends.

30. The antenna system of claim 24, wherein said switching means comprise gallium arsenide field effect transistors.

31. The antenna system of claim 24, wherein each of said filar helices comprises a helix with a pitch angle greater than about 55 degrees and less than about 85 degrees.

32. The antenna system of claim 24, further comprising at least one microelectronic substrate, and wherein said quadrifilar helix antenna, said transmit and receive 90° hybrid couplers, said switching means and said matching means are implemented on said at least one microelectronic substrate.

33. A method for transmitting electrical signals from a transmitter and for receiving electrical signals at a receiver using an antenna system comprising a quadrifilar helix antenna and first and second circuit branches for changing the resonant frequency of said antenna to first and second resonant frequencies, the method comprising the steps of:

(a) coupling the signal from said quadrifilar helix antenna to said second circuit branch while electrically isolating said transmitter and said first circuit branch from said receiver;

(b) coupling said signal from said second circuit branch to said quadrifilar helix antenna while electrically isolating said transmitter and said first circuit branch from said receiver;

(c) coupling the signal from said transmitter to said first circuit branch while electrically isolating said receiver and said second circuit branch from said transmitter; and (d) coupling said signal from said first circuit branch to said quadrifilar helix antenna while electrically isolating said receiver and said second circuit branch from said transmitter.

34. A method according to claim 33, wherein said antenna system further includes a plurality of switches interposed along each electrical connection between said receiver and said quadrifilar helix antenna and between said transmitter and said quadrifilar helix antenna and wherein said electrical isolation is provided by closing the switches between the devices which are to be isolated.

35. A handheld transceiver for transmitting and receiving radio frequency signals comprising:

(a) a quadrifilar helix antenna;

(b) first circuit branch means for changing the resonant frequency of said quadrifilar helix antenna to a first resonant frequency;

(c) second circuit branch means for changing the resonant frequency of said quadrifilar helix antenna to a second resonant frequency;

(d) coupling means for coupling the signal from said quadrifilar helix antenna to said receiver and for coupling the signal from said transmitter to said quadrifilar helix antenna;

(e) first disconnecting means for electrically isolating said first circuit branch from said quadrifilar helix antenna;

(f) second disconnecting means for electrically isolating said second circuit branch from said quadrifilar helix antenna;

(g) a transmitter;

(h) a receiver; and (i) a user interface.

36. The transceiver of claim 35, wherein said coupling means comprises first coupling means for coupling the signal from said transmitter to said quadrifilar helix antenna and second coupling means for coupling the signal from said quadrifilar helix antenna to said receiver.

37. The transceiver of claim 35, wherein said first coupling means comprises a transmit 90° hybrid coupler having two input ports and wherein said second coupling means comprises a receive 90° hybrid coupler having two output ports.

38. The transceiver of claim 35, wherein said quadrifilar helix antenna comprises a first filar coupled at its origin to both the first output port on said transmit 90° hybrid coupler and the first input on said receive 90° hybrid coupler, a second filar coupled at its origin to both the second output port of said transmit 90° hybrid coupler and the second input of said receive 90° hybrid coupler, and third and fourth filars coupled at their origin to a first reference voltage, and wherein said first and third filars are electrically connected at their distal ends and said second and fourth filars are electrically connected at their distal ends.

39. The transceiver of claim 35, wherein said first circuit branch means and said second circuit branch means comprise reactive elements to thereby change the resonant frequency of said quadrifilar helix antenna.

40. The transceiver of claim 35, wherein said first disconnecting means comprises a plurality of switching means interposed along each electrical connection between said transmitter and said quadrifilar helix antenna and wherein said second disconnecting means comprises a plurality of switching means interposed along each electrical connection between said receiver and said quadrifilar helix antenna.

41. The transceiver of claim 35, wherein said switching means comprise gallium arsenide field effect transistors.

42. The transceiver of claim 35, further comprising matching means coupled to the elements of said quadrifilar helix antenna for increasing the operating bandwidth of said quadrifilar helix antenna.

* * * * *